US008950655B2

(12) United States Patent
Okezawa

(10) Patent No.: US 8,950,655 B2
(45) Date of Patent: Feb. 10, 2015

(54) METHOD OF MANUFACTURING PACKAGING CONTAINER AND PACKAGING CONTAINER

(75) Inventor: Hiroaki Okezawa, Tokyo (JP)

(73) Assignee: Tetra Laval Holdings & Finance, S.A., Pully (CH)

( * ) Notice: Subject to any disclaimer, the term of this patent is extended or adjusted under 35 U.S.C. 154(b) by 0 days.

(21) Appl. No.: 13/991,179

(22) PCT Filed: Dec. 2, 2011

(86) PCT No.: PCT/JP2011/077907

§ 371 (c)(1),
(2), (4) Date: Jul. 8, 2013

(87) PCT Pub. No.: WO2012/077595

PCT Pub. Date: Jun. 14, 2012

(65) Prior Publication Data

US 2013/0299565 A1 Nov. 14, 2013

(30) Foreign Application Priority Data

Dec. 7, 2010 (JP) ..... 2010-272253

(51) Int. Cl.

| | |
|---|---|
| ***B65D 5/06*** | (2006.01) |
| ***B65D 5/40*** | (2006.01) |
| ***B65D 77/22*** | (2006.01) |
| ***B65B 9/20*** | (2012.01) |
| ***B65B 61/24*** | (2006.01) |
| ***B65D 5/02*** | (2006.01) |
| ***B65D 5/74*** | (2006.01) |

(52) U.S. Cl.

CPC ..... *B65D 77/22* (2013.01); *B65B 9/2056* (2013.01); *B65B 61/24* (2013.01); *B65D 5/029* (2013.01); *B65D 5/064* (2013.01); *B65D 5/746* (2013.01)

USPC ..... 229/112; 53/450; 53/451; 229/115; 229/137

(58) Field of Classification Search

USPC ..... 229/112, 115, 125.42, 137, 208, 216, 229/247, 248, 249; 53/450, 451

See application file for complete search history.

(56) References Cited

U.S. PATENT DOCUMENTS 928,423 A * 7/1909 Belson ..... 229/115
2,063,645 A * 12/1936 Ware ..... 229/115

(Continued)

FOREIGN PATENT DOCUMENTS

JP 60-045140 A 3/1985
JP 62-146141 A 6/1987

(Continued)

OTHER PUBLICATIONS

International Search Report of PCT/JP2011/077907 dated Mar. 6, 2012, 2 pages.

*Primary Examiner* — Gary Elkins
(74) *Attorney, Agent, or Firm* — Finnegan, Henderson, Farabow, Garrett & Dunner, L.L.P.

(57) ABSTRACT

A packaging container including a top wall and a bottom wall that are substantially horizontal when the packaging container is straight, and side walls. The top wall and the bottom wall have a triangular shape and a rectangular shape, respectively, a section of a transverse direction of a main body of the packaging container formed in four ridgelines which connect three corner points of the top wall and four corner points of the bottom wall has a trapezoidal shape, and the horizontal top wall overhangs a front side wall.

3 Claims, 7 Drawing Sheets

(56) References Cited

U.S. PATENT DOCUMENTS

| | | | | |
|---|---|---|---|---|
| 3,369,727 | A | 2/1968 | Wright | |
| 5,531,375 | A * | 7/1996 | Palm | 229/137 |
| 5,546,733 | A * | 8/1996 | Paltrinieri | 53/451 |
| 5,897,050 | A * | 4/1999 | Barnes | 229/112 |
| 5,938,107 | A * | 8/1999 | Anchor et al. | 229/137 |
| 6,182,887 | B1 * | 2/2001 | Ljunstrom et al. | 229/112 |
| 6,929,171 | B1 | 8/2005 | Thiersch | |
| 7,934,637 | B2 * | 5/2011 | Kaneko | 229/125.42 |

FOREIGN PATENT DOCUMENTS

| | | | |
|---|---|---|---|
| JP | 4-53602 | U | 5/1992 |
| JP | 6-78222 | | 11/1994 |
| JP | 7-187181 | A | 7/1995 |
| JP | 11-236027 | A | 3/1999 |
| JP | 11-91792 | A | 4/1999 |
| JP | 2005-035583 | A | 2/2005 |
| WO | WO 02/10020 | A1 | 2/2002 |
| WO | WO 2004/076302 | A1 | 9/2004 |

* cited by examiner

METHOD OF MANUFACTURING PACKAGING CONTAINER AND PACKAGING CONTAINER

CROSS-REFERENCE TO RELATED APPLICATIONS

This is a U.S. National Phase of PCT/JP2011/077907, filed Dec. 2, 2011, which claims the benefit of priority to Japanese Patent Application No. 2010-272253, filed Dec. 7, 2010, which is incorporated herein by reference.

FIELD OF THE INVENTION

The present invention is related about a method of manufacturing a packaging container filled up with liquid products of cow's milk, juice, alcoholic beverage, mineral water, green tea, etc., and its packaging container.

BACKGROUND ART

The package laminating material made of paper having rich flexibility has been used to package liquid products of liquid food over many years. In the packaging container 20 as shown in FIG. 10 for cow's milk, juices, sake, white distilled liquor, mineral water, and other beverages, for example, web-like package laminated material of fiber base materials (for example, paper etc.)/plastic laminate having crease lines is formed into a tube shape by the longitudinal seal of the longitudinal direction, is filled up with content into the tube shaped packaging material, and is transversally sealed to the transverse direction of the tube shaped packaging material, and is formed into the cushion or pillow shaped packaging body (primary shape container).

The pillow shaped packaging body is cut individually for every one container in the transversal seal portion, and is folded up to mountain folds and valley folds along creasing lines, and the brick shaped container 20 having panels 21*a* and 21*b* which form the side walls, a longitudinal sealed portion 22, transverse seal portion 23 of fins, a panel 24 which forms a top wall, and flaps 25 (pieces folded at forming the top wall and the bottom portion) sealed onto the side walls as shown in FIG. 10 is formed.

A gable-top shaped (gable roof like) paper packaging container is obtained by cutting the paper packaging material into the predetermined shape, obtaining blanks sealed to the container lengthwise direction, after bottom sealing of blanks in a filling machine, filling cow's milk, juices, or other beverages from the upper opening, and sealing the upper part. The appearance designs of packaging container and products are printed on the surface at the packaging materials.

The crease lines for the one container are repeatedly given to the web-like packaging material continuously. FIG. 11 showing the partial packaging material for one container is referred to. In the web-like packaging material with the crease lines, the packaging material 27 for one container comprises a seal area 28 for the longitudinal seals, a transversal seal area 29 for the transversal seal to the transverse direction of the tube shaped packaging material, side panels 21*a* and 21*b* to be formed to container walls, panels 24*a*, 24*b*, and 24*c* to be formed to a top panel of the container, panels 25*a*, 25*b*, and 25*c* to be formed to flaps 25 which is folded up and sealed on the side panel or the bottom, and crease lines 26 formed in the borders between the panels.

There are a pentagonal pillar shaped container, a hexagon pillar shaped container, a shed roof shaped container, an octagonal pillar shaped container besides the above-mentioned brick shaped container and the gable top container. (See patent documents)

PRIOR ART DOCUMENT

Patent Documents

Patent documents 1: JP,11-91792,A
Patent documents 2: JP,11-236027,A
Patent documents 3: JP,4-53602,U
Patent documents 4: WO 2002/010020
Patent documents 5: JP,7-187181,A

SUMMARY OF THE INVENTION

Problem to be Solved by the Invention

The object of the present invention is providing the manufacturing method of a newly-shaped packaging container and the newly-shaped container, in containers formed by forming a weblike package laminated material having crease lines into a tube shape to seal to the longitudinal direction, by sealing the tube at the interval for one container to cut the tube to the transverse direction, and by folding flaps and fins of the obtained pillow-shaped packaging body onto a top wall, side walls, and a bottom wall.

Another object of this invention is, in the above-mentioned container having the shape of the new triangular prism, to provide a container which consumers easily pour out and easily hold, and a method of manufacturing the container.

The another object of this invention is, according to uses of liquid products of soft drinks such as juices and viscous products such as sauce, catsup and etc., to provide the container which can increase the flexibility of the design of a spout and an opening device such as a cap, a straw and etc., and which can increase the flexibility to the design and printing of the container appearance, and the method of manufacturing the container.

Means to Solve the Problem

The packaging container of the present invention is obtained by tube forming by longitudinal sealing of the web-like packaging material, filling of liquid products into the tube shaped packaging material, transversal sealing to the transverse direction of the tube shaped packaging material, forming of pillowy packaging bodies, individual cutting of the pillowy packaging bodies, folding up along the crease lines to form a top wall, side walls and a bottom wall, and attaching fins and flaps which are formed to the above-mentioned walls to form to a final shape, characterized by that the top wall and the bottom wall are substantially horizontal when the packaging container stands straight, the top wall and the bottom wall have a triangular shape and a rectangular shape, respectively, a section of a transverse direction of a main body of the packaging container formed in the four ridgelines which connect three corner points of the top wall and four corner points of the bottom wall has a trapezoidal shape, and one corner point of the horizontal top wall overhangs the front side wall.

In the preferable embodiment of this invention, an opening for a straw, a pouring plug, and an opening device is provided with on the overhung portion of the top wall.

The method of manufacturing a packaging container according to this invention which comprise forming web-like packaging material having crease lines to tube shape by longitudinal sealing, filling up with a liquid product in the tube shaped packaging material, transversal sealing the tube shaped packaging material to the transverse direction to form pillow shaped packaging bodies, cutting the packaging bodies individually, folding up the packaging body along the crease lines to form a top wall, side walls and a bottom wall, and attaching the obtained fins and flaps to the above-mentioned walls to form a final shape, characterized that the top wall and the bottom wall are substantially horizontal when the packaging container stands straight, the top wall and the bottom wall have a triangular shape and a rectangular shape, respectively, a section of a transverse direction of a main body of the packaging container formed in the four ridgelines which connect three corner points of the top wall and four corner points of the bottom wall has a trapezoidal shape, and one corner point of the horizontal top wall overhangs the front side walls.

In the feature of the manufacturing method of this invention, in the filling, the liquid product is filled up by volume equivalent to a constant volume of the final shaped packaging container into the packaging material while a cross-sectional area in the tube shaped packaging material is reduced, in the transversal seal, the constant volume is kept at the sealing, and in the final shaped forming, the container wall of the packaging body is deformed inside and the constant volume is kept.

Effect of the Invention

According to the present invention of the above-mentioned structure, the following effect functions are shown and the advantageous effect is acquired.

With the packaging container of the present invention, the new shaped container obtained from the pillowy packaging body can be provided.

With the paper packaging container of this invention, the consumers can begin easy pouring from the overhang with the overhang from the triangular horizontal top wall.

The comparatively large-sized spout, the opening device, and the wide-mouthed extraction device (spout) can be attached to the overhang, and the consumers can pour it easily.

With the paper packaging container of this invention, the novel container design can be provided and it can be a customer attractive container for the consumers in the display rack of the retail store.

Since the sectional shape of the package body is triangular, the container can provide the container which is easily taken and grasped by the consumers, even if a baby and a child with small hands are the consumers.

Although the paper packaging containers are arranged in series in low and deep display rack in the retail store and the consumers cannot hand out easily at their shopping, they can take it by holding the both side walls.

According to liquid products of soft drinks such as the juice, viscous products such as sauce, catsup, and etc., opening methods and pouring methods differ from each other. According to uses, the spouts and the opening devices such as caps and straws, and etc. can be designed freely.

The container shape itself is new, and the container appearance can be designed more freely and can be printed.

In the feature of this manufacturing method, in the filling and the transversal sealing, since the cross-sectional area in the inner tube is reduced, and the packaging body is deformed for forming, the newly angular packaging container can be formed effectively with no damage.

DENOTATION OF REFERENCE NUMERALS

Figure 1:
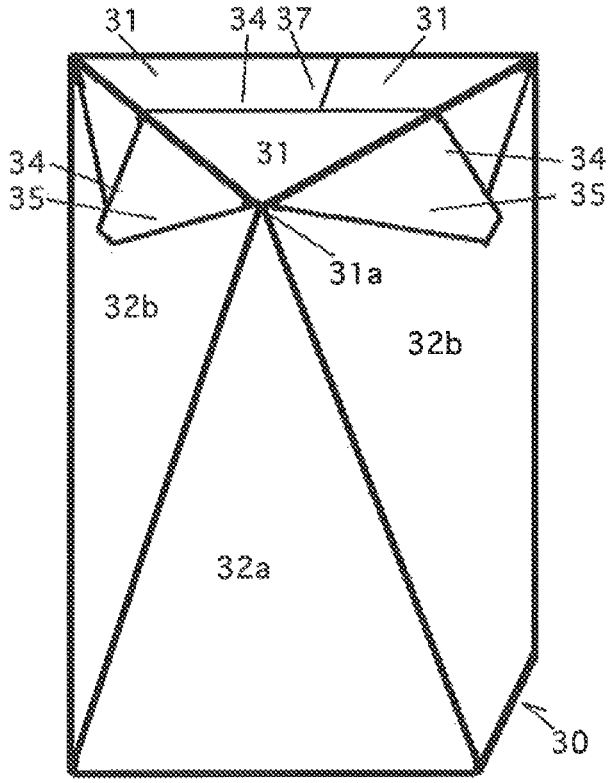
FIG. 1. Perspective outline view showing the 1st example of the packaging container according to this invention.

1 packaging material
30 packaging container
31 top wall
32 side wall
33 bottom wall
34 fin
35 flap

BEST MODE FOR CARRYING OUT THE INVENTION

Preferred embodiments of the present invention will hereinafter be described in detail with reference to the attached drawings.

Figure 12:
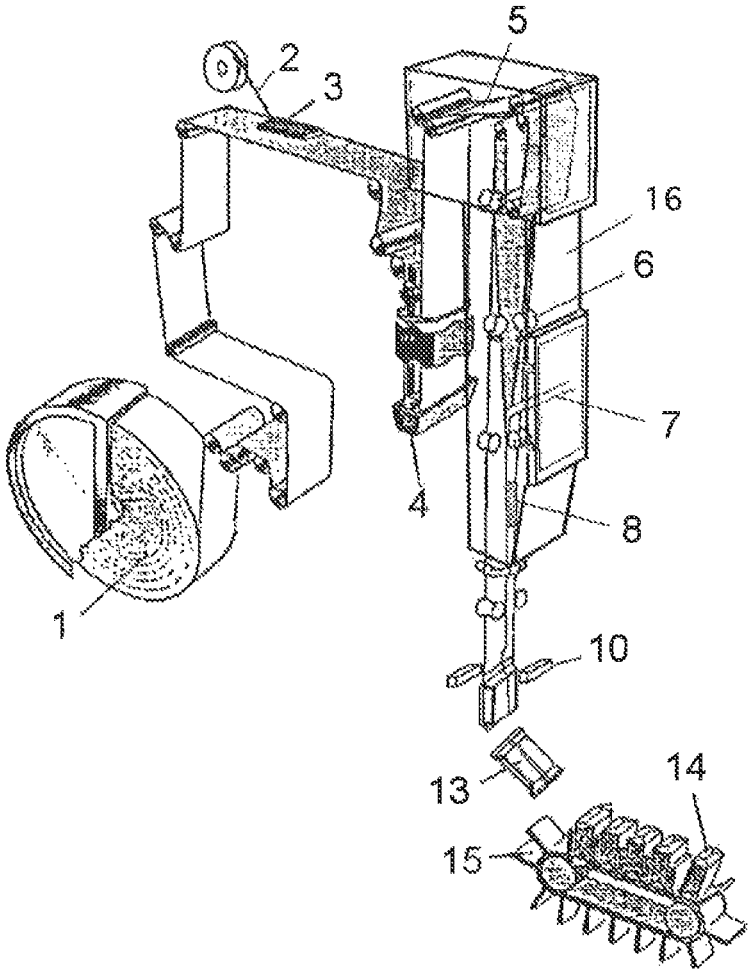
FIG. 12. Schematic diagram of the package filling machine which can be used for the manufacturing method of the packaging container according to this invention.

The example of the package filling machine shown in FIG. 12 explains this mode. In this example of the machine, the web-like package laminated material 1 having crease lines is fed in the package filling machine with the shape of a reel. The package laminated material 1 comprises a flexible laminate in which a paper substrate and polyethylene resin films laminated on both sides of the paper substrate, conducting layers, such as aluminum foil, are formed between the paper substrate and the film, and printing for the exterior is beforehand performed to the portion corresponding on the surface of the packaging container.

By the transportation means, the fed package laminated material 1 is conveyed continuously, and is used for package filling.

The package laminated material 1 is fed to a strip applicator 3, and a strip is applied along one edge of the package laminated material 1 by the strip applicator.

The package laminated material 1 is fed to a sterilization bath 4, and is sterilized with sterilization liquid, such as hydrogen peroxide, in the sterilization bath 4. The package laminated material 1 is fed to an aseptic chamber 16, after feeding to an air knife for drying with the air knife. The package laminated material 1 is gradually deformed by forming rings 6, and is formed into tube shape.

Both edge sections of the tube shaped package laminated material are pressed and longitudinal sealed with the strip with a longitudinal seal apparatus 8. Fluid food product supplied via a filling pipe 7 is filled into the tube shaped package laminated material 1.

The tube shaped package laminated material is guided with rollers, and it is transversally sealed in the transverse direction with the transversal seal apparatus 10, and the transversally sealed package laminated material is cut with the knife and the like, and the pillowy packaging body 13 is formed.

The pillowy packaging body 13 is formed with a final shape folding apparatus 15 to the final shape, and the packaging container 14 with the fluid food product is obtained.

Figure 2:
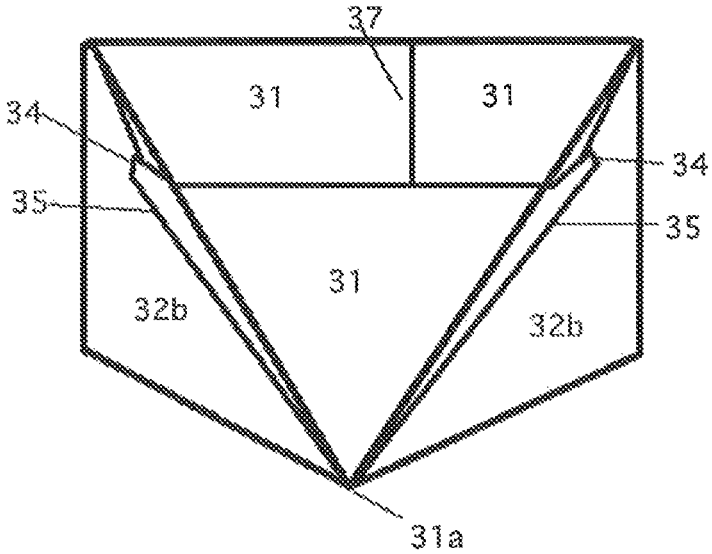
FIG. 2. Top view of the container of the 1st example.
Figure 3:
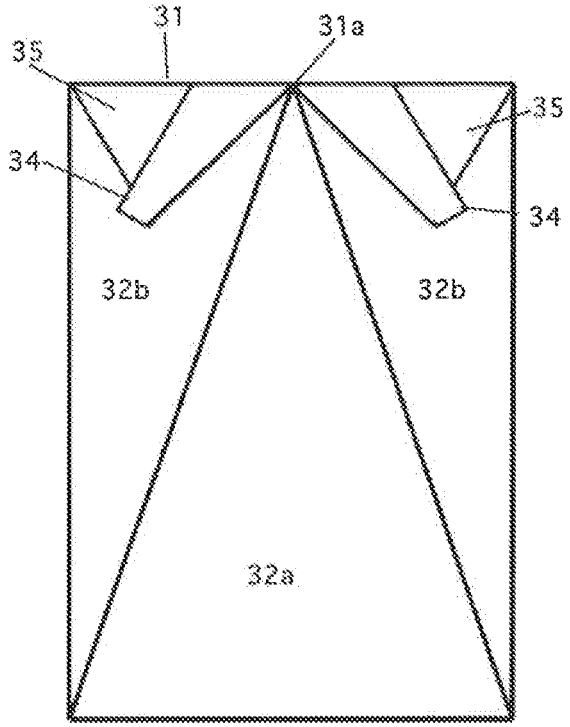
FIG. 3. Front view of the container of the 1st example.
Figure 4:
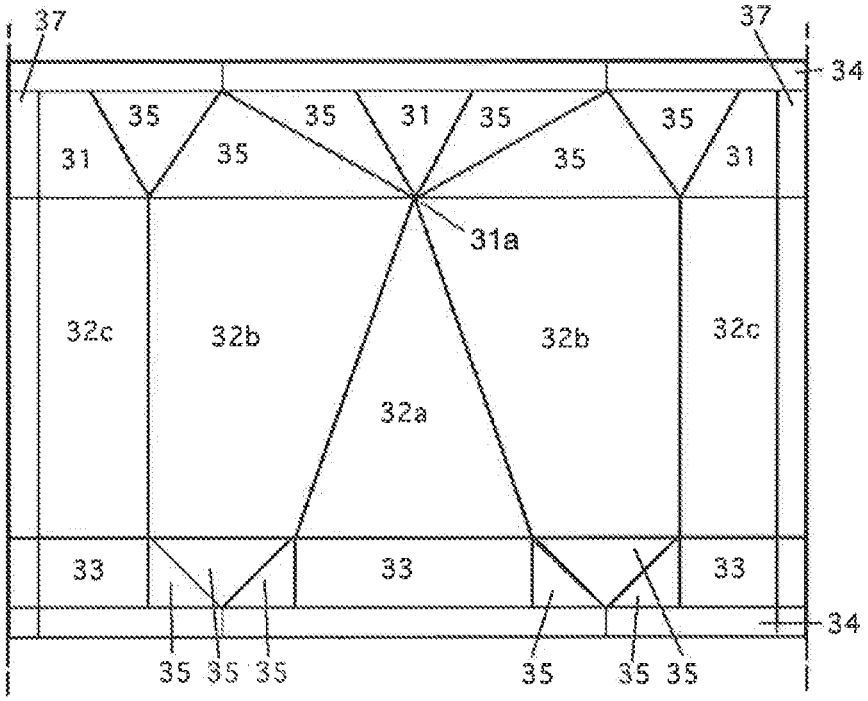
FIG. 4. Development view of one container of the 1st example.
Figure 5:
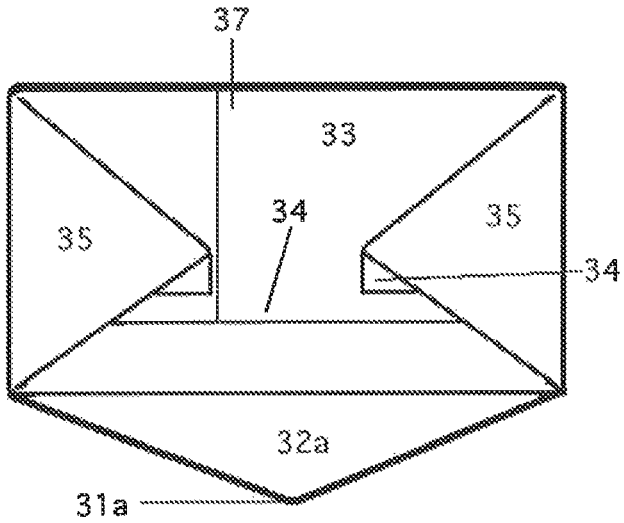
FIG. 5. Bottom view of the container of the 1st example.
Figure 6:
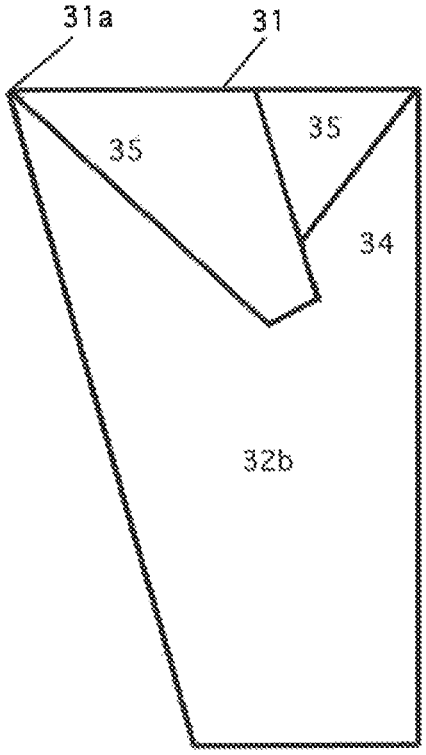
FIG. 6. Side view of the container of the 1st example.

The 1st example of the packaging container according to this invention is shown in the perspective outline view of FIG. 1, in the top view of FIG. 2, in the front view of FIG. 3, in the development view of FIG. 4, in the bottom view of FIG. 5, and in the side view of FIG. 6.

The packaging container 30 of the 1st example is the packaging container obtained by forming to the final shape which has the top wall 31, the side walls 32*a*, 32*b* and 32*c*, and the bottom wall 33 which are formed by folding along the crease lines, and, in the packaging container, the fins 34 and the flaps 35 formed in process of the folding are attached to the above-mentioned side wall 32*b* and the bottom wall 33.

As shown in the front view of FIG. 3, and the side view of FIG. 6, the top wall 31 and the bottom wall 33 are substantially horizontal when the packaging container 30 stands straight. Since the bottom wall 33 is horizontal, the packaging container can be stood stably.

As shown in the perspective outline view of FIG. 1, the top view of FIG. 2, and the bottom view of FIG. 5, the top wall 31 and the bottom wall 33 have the trapezoidal shape and the rectangular shape, respectively.

As shown in the perspective outline view of FIG. 1, the section of the transverse direction of the main body of the packaging container formed in the four ridgelines which connect the three corner points of the top wall 31 and the four corner points of the bottom wall 33 is trapezoidal. Although it is simple, it can be considered as a new and novel container appearance.

As shown in the perspective outline view of FIG. 1, and the side view of FIG. 6, the horizontal top wall 31 has the overhang (31*a*) to the front side walls. With such overhang, when a consumer begins to pour out liquid products from the container, the overhang enables the consumers to pour out easily them without any liquid drips.

In the embodiment of the 1st example, although the rear view is not illustrated, the packaging container has the longitudinal seal 37 on the side of the rear side wall 32*c*.

The top fin 34 of the transversal seal portion is folded to the back side (rear wall side), and the two folded pieces 35 (flaps) are folded and attached on the wall surface of the side-wall panel 32*b*, as illustrated.

On the other hand, the lower fin 34 is folded to the forward side (front wall side), and as shown in the bottom view of FIG. 5, the two folded pieces 35 (flaps) are folded and attached on the wall surface of the bottom-wall panel 33.

In this embodiment, an easily openable portion for the spout or the straw (not shown) is formed on the top wall 31.

The web-like packaging material with the crease lines is formed with the packaging material for the one container as shown in FIG. 4 continuously, like a web. The packaging material comprises seal areas 37 for the longitudinal seals which are provided in the edges of the packaging material in the longitudinal direction of the web-like packaging material, transversal seal areas 34 and 34 for the transversal seal which are provided up and down adjoining portions in the transverse direction of the tube shape packaging material, side-wall panels 32*a*, 32*b*, 32*b*, 32*c*, and 32*c* for forming the container walls, panels 31, 31, and 31 for forming the top wall of the container, panels 33, 33, and 33 for forming the container bottom wall, 12 panels 35 for forming the flaps (folded pieces) which is folded up and sealed on the side wall, and crease lines formed in the borders between the panels.

In this embodiment, the width of the panel 35 (by the side of the side-wall panel 32*b*) of the top flaps is wider than the width of the panel 35 (by the side of the side-wall panel 32*b*) of the lower flaps, and the crease lines of the top wall panel 31, the side-wall panels 32*b*, 32*a* and 32*b*, and the panels 35, 35, 35, and 35 of the top flap concentrate on the overhung point (31*a*) of the top wall so that the top wall 31 may become a triangular shape.

The panels 35, 35, and 35 which form the top flap are triangular, respectively, and the combined three panels occupy a block surrounded with the adjoining side-wall panel 32*b*, the top wall panels 31 and 31, and the fin (transversal seal portion) 34.

The panels 35, 35, and 35 which form the lower flap are triangular, respectively, and the combined three panels occupy a block surrounded with the adjoining side-wall panel 32*b*, the bottom wall panels 33 and 33, and the fin (transversal seal portion) 34.

In the preferable embodiment by this invention, the 2nd example of the packaging container which is provided with the large-sized spout on the top wall is described with reference to FIG. 7 and FIG. 8.

Figure 7:
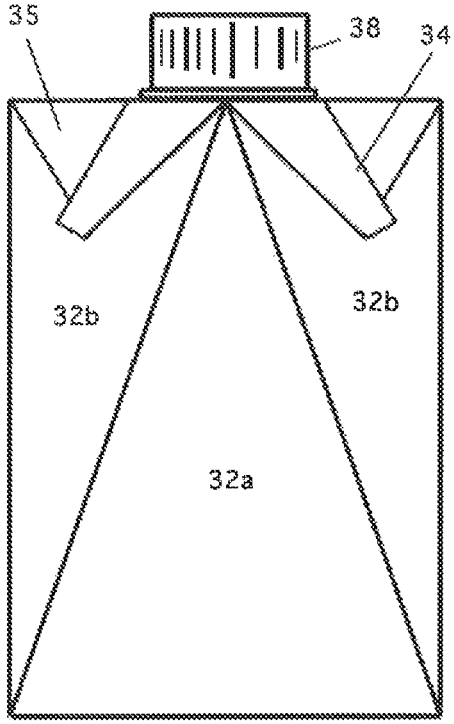
FIG. 7. Front view of the container of the 2nd example.
Figure 8:
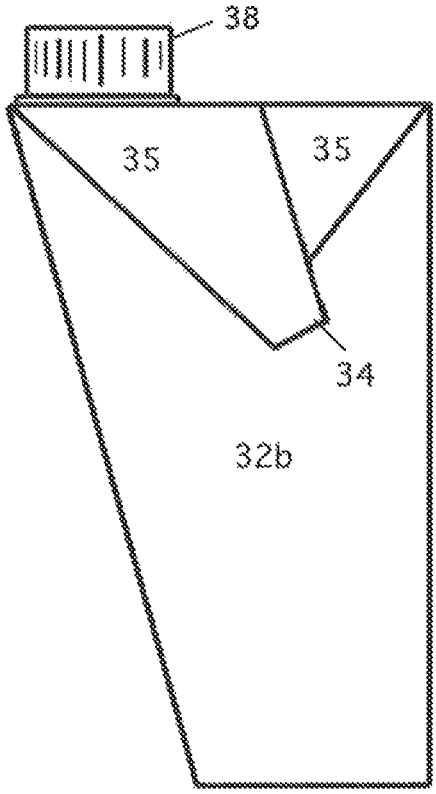
FIG. 8. Side view of the container of the 2nd example.

FIG. 7 and FIG. 8 show the example of the container which attached a screw cap 38. The packaging container 30 has, in this embodiment, the top wall 31, the side walls 32*a*, 32*b* and 32*c*, and the bottom wall 33 folded up and formed along the crease lines, in the fin 34 and the flap 35 formed in process of the folding, the top flaps 35 are attached to the side wall 32*b* and 32*b*, and the lower flaps are attached to the bottom wall 33. The mode that the cap 38 is attached adjacent to the overhang of the top wall 31 is shown in FIG. 7 and FIG. 8.

As shown in the front view of FIG. 7 and the side view of FIG. 8, the top wall 31 and the bottom wall 33 are substantially horizontal when the packaging container 30 stands straight.

The section in the transverse direction of the main body of the packaging container formed in the ridgelines which connect the corner points of the top wall 31 and the corner points of the bottom wall 33 is trapezoidal.

As shown in the front view of FIG. 7, it is simple, and it has a new and novel container appearance.

As shown in the side view of FIG. 8, the horizontal top wall 31 has the overhang 31*a* to the front side wall 32*a*. The overhang 31*a* enables the consumers to pour out the liquid without any liquid drips.

In the embodiment, a large-sized screw cap 38 is attached to one edge of the top wall 31. With the spout on the overhang, the liquid product can be poured easily.

The consumers can begin easy pouring from the overhang with the overhang from the horizontal top wall.

With the overhang having the sectional-triangular shape, the container is easily taken and grasped by the consumers, even if a baby and a child with small hands is the consumer.

Even if the paper packaging containers are arranged in series in low and deep display rack in the retail store, the consumers can take them by holding the both side walls.

Figure 9:
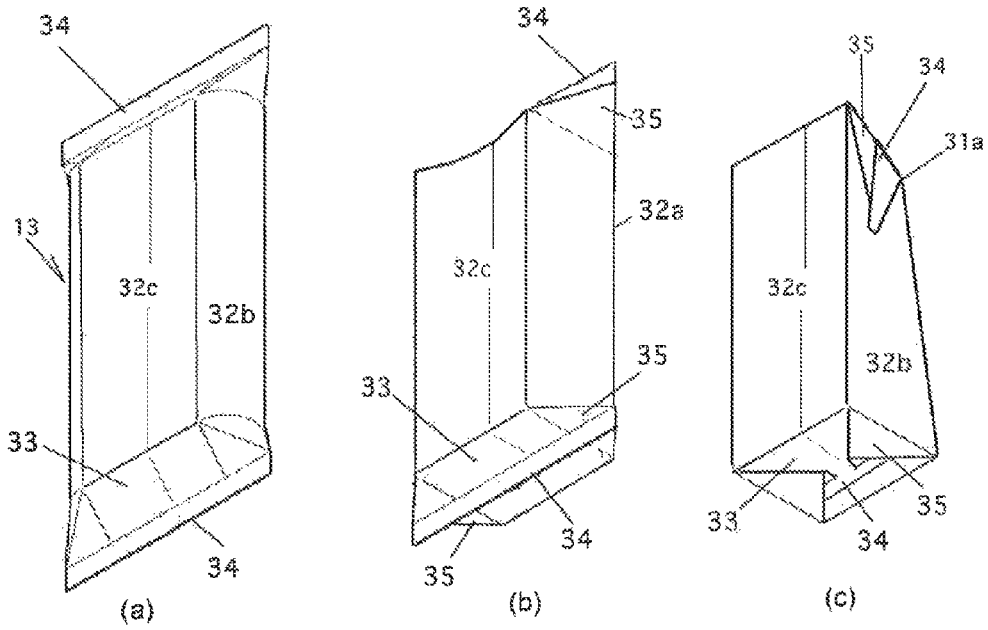
FIG. 9. Perspective view showing steps formed to the container of the 1st example from the pillowy packaging body.
Figure 10:
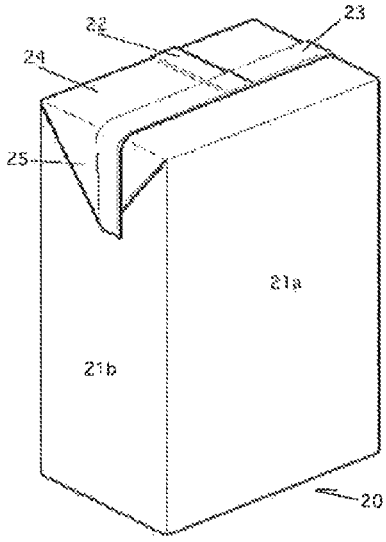
FIG. 10. Perspective view of the brick-like packaging container.
Figure 11:
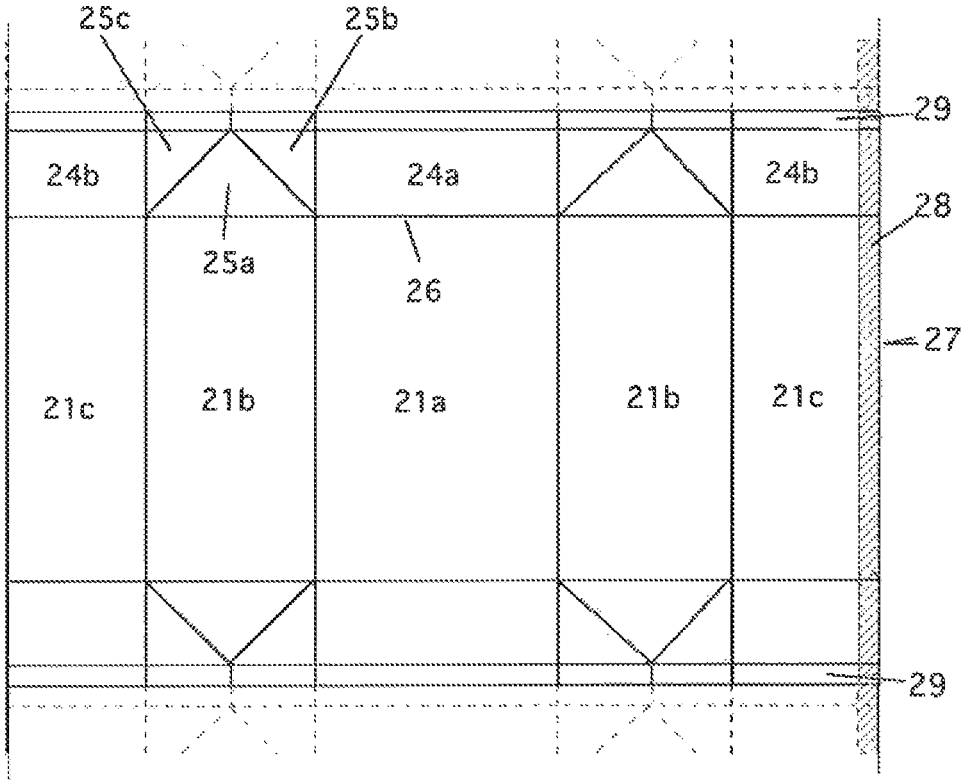
FIG. 11. Development top view of the brick-like packaging container.

With reference to FIG. 9 showing the step formed from the pillowy packaging body 13, an example of the manufacturing method of the packaging container 30 of the 1st example is explained concretely.

In the forming step (a) shown in FIG. 9, as shown in FIG. 12, the pillowy packaging body 13 obtained by filling with the liquid products into the tube shape package laminated material 1, transversal sealing, and cutting and tentatively folded along the crease lines is prepared.

In the filling of the preparation step, the cross-sectional area in the tube shape packaging material is reduced. The liquid product is filled in volume equivalent to the constant volume of the final shaped packaging container in the packaging material. Specifically, the sectional shape of the tube includes the shape of an ellipse, the shape of a gourd, the approximately lozenge, and the like.

The above-mentioned constant volume is maintained and the transversal seal is sealed.

In the forming step (b), the side walls by the side of the side wall 32*b* are pressed inside so that both ends of the upper and lower transversal seal portions (fins) 34 may be projected to the side-wall 32*b* side.

In the forming step (c), the upper transversal seal portions (fins) 34 are folded by the rear side-wall 32*c*, the two upper folded pieces 35 (flaps) are formed, and attached on the wall surface of the side-wall panel 32*b*, and the two lower folded pieces 35 (flaps) are formed, and attached on the wall surface of the bottom panel 33.

In the above-mentioned forming steps, the container wall of the packaging body is deformed inside and the constant volume is maintained. For example, the surface of the side-wall 32*c* and/or 32*a* with the wide container wall area is pressed, and the hollow is formed and held.

Since the packaging material has flexibility, the packaging container can be formed effectively without any damage and the defect.

The present invention is not limited to the embodiment, and it is possible to make it deform variously based on the object of the present invention, and it does not eliminate them from the scope of the present invention.

INDUSTRIAL APPLICABILITY

This invention is applicable to manufacturing of package filling of the liquid food.

The invention claimed is:

1. A packaging container, comprising:

a top wall and a bottom wall that are substantially horizontal when the packaging container is straight; and side walls, wherein the top wall and the bottom wall have a triangular shape and a rectangular shape, respectively, a section of a transverse direction of a main body of the packaging container formed in four ridgelines which connect three corner points of the top wall and four corner points of the bottom wall has a trapezoidal shape, and the horizontal top wall overhangs a front wall of the side walls.

2. The packaging container according to claim 1, further comprising an opening for an opening device on the top wall.

3. A method of manufacturing a packaging container, comprising:

forming a web-like packaging material having crease lines to into a tube shape by longitudinal sealing;

filling the tube shaped packaging material with a liquid product;

sealing the tube shaped packaging material in a transverse direction to form pillow shaped packaging bodies;

cutting the packaging bodies individually;

folding the packaging body along the crease lines to form a top wall, side walls, and a bottom wall; and attaching one or more fins and flaps to the top wall, bottom wall, or side walls to form a final shape, wherein the top wall and the bottom wall are substantially horizontal when the packaging container is straight, wherein the top wall and the bottom wall have a triangular shape and a rectangular shape, respectively, a section of a transverse direction of a main body of the packaging container formed in four ridgelines which connect three corner points of the top wall and four corner points of the bottom wall has a trapezoidal shape, and one corner of the horizontal top wall overhangs a front wall of the side walls, and wherein during the filling, the liquid product is filled to a volume equivalent to a predetermined volume of the final shaped packaging container with a cross-sectional area in the tube shaped packaging material being initially reduced, during the sealing, the predetermined volume is maintained, and during the forming, the predetermined volume is maintained by deforming the container wall of the packaging body.

* * * * *